US009138794B2

(12) United States Patent
Imaeda et al.

(10) Patent No.: US 9,138,794 B2
(45) Date of Patent: Sep. 22, 2015

(54) PRESS MACHINE

(75) Inventors: Wataru Imaeda, Inuyama (JP); Akinobu Watanabe, Inuyama (JP)

(73) Assignee: Murata Machinery, Ltd., Kyoto (JP)

( * ) Notice: Subject to any disclaimer, the term of this patent is extended or adjusted under 35 U.S.C. 154(b) by 280 days.

(21) Appl. No.: 13/819,740

(22) PCT Filed: Aug. 9, 2011

(86) PCT No.: PCT/JP2011/068096
§ 371 (c)(1),
(2), (4) Date: Feb. 28, 2013

(87) PCT Pub. No.: WO2012/032892
PCT Pub. Date: Mar. 15, 2012

(65) Prior Publication Data

US 2013/0152661 A1 Jun. 20, 2013

(30) Foreign Application Priority Data

Sep. 9, 2010 (JP) ..... 2010-201879

(51) Int. Cl.
*B21D 5/02* (2006.01)
*B30B 15/02* (2006.01)
*B30B 1/23* (2006.01)
(Continued)

(52) U.S. Cl.
CPC ..... *B21D 5/02* (2013.01); *B21D 5/0272* (2013.01); *B30B 1/18* (2013.01); *B30B 1/23* (2013.01); *B30B 1/32* (2013.01); *B30B 15/026* (2013.01); *B30B 15/16* (2013.01); *B30B 15/163* (2013.01); *B30B 15/183* (2013.01)

(58) Field of Classification Search
CPC ..... B21D 5/02; B21D 5/004; B30B 1/23; B30B 1/32; B30B 15/16; B30B 15/163; B30B 15/1835
See application file for complete search history.

(56) References Cited

U.S. PATENT DOCUMENTS 7,284,407 B2 10/2007 Imaeda
2005/0204798 A1 9/2005 Imaeda
(Continued)

FOREIGN PATENT DOCUMENTS

JP 07-266086 A 10/1995
JP 10-180499 A 7/1998
(Continued)

OTHER PUBLICATIONS

Official Communication issued in corresponding European Patent Application No. 11823371.7, mailed on May 27, 2014.
(Continued)

*Primary Examiner* — Teresa M Ekiert
(74) *Attorney, Agent, or Firm* — Keating & Bennett, LLP

(57) ABSTRACT

A press machine includes a lifting mechanism that selectively lowers and lifts a die on a movable side. The lifting mechanism includes a motor driven lifting unit using a servomotor as a drive source thereof, and a hydraulically driven lifting unit using a hydraulic actuator as a drive source thereof. The lifting mechanism is controlled so as to enable the motor driven lifting unit to move the die on the movable side from a standby position to a drive system changeover position immediately before a press start position at which the die on the movable side starts contacting a workpiece to be processed and so as to enable the hydraulically driven lifting unit to move the die on the movable side from the drive system changeover position to a top dead center position.

5 Claims, 9 Drawing Sheets

(51) Int. Cl.

| | |
|---|---|
| ***B30B 1/18*** | (2006.01) |
| ***B30B 1/32*** | (2006.01) |
| ***B30B 15/16*** | (2006.01) |
| ***B30B 15/18*** | (2006.01) |

(56) References Cited

U.S. PATENT DOCUMENTS

| | | | |
|---|---|---|---|
| 2008/0134909 | A1 | 6/2008 | Kohno et al. |
| 2008/0202115 | A1 | 8/2008 | Geiger |

FOREIGN PATENT DOCUMENTS

| | | | |
|---|---|---|---|
| JP | 2004-188460 | A | 7/2004 |
| JP | 3558679 | B2 | 8/2004 |
| JP | 2006-150422 | A | 6/2006 |

OTHER PUBLICATIONS

Official Communication issued in International Patent Application No. PCT/JP2011/068096, mailed on Oct. 25, 2011.

English translation of Official Communication issued in corresponding International Application PCT/JP2011/068096, mailed on Apr. 18, 2013.

PRESS MACHINE

CROSS REFERENCE TO THE RELATED APPLICATION

This application is based on and claims Convention priority to Japanese patent application No. 2010-201879, filed Sep. 9, 2010, the entire disclosure of which is herein incorporated by reference as a part of this application.

BACKGROUND OF THE INVENTION

1. Field of the Invention

The present invention relates to a press machine such as, for example, a press brake.

2. Description of the Related Art

When a press brake is classified according to a drive system of a ram, two types are generally available; a hydraulic drive system utilizing a hydraulic cylinder and a motor drive system utilizing a servo motor. The motor drive system is of a type in which a revolving motion of a servomotor is translated into a linear motion by means of a motion translating mechanism such as, for example, a ball screw mechanism. In addition to those two systems referred to above, a composite drive system utilizing the servomotor and the hydraulic cylinder concurrently (such as disclosed in JP Patent No. 3558679) and a dual servomotor system utilizing two servomotors that play different roles (such as disclosed in JP Laid-open Patent Publication No. 2004-188460) have been suggested.

The hydraulic drive system and the motor drive system have their own merits and demerits. In general, the hydraulic drive system is known to be effective in providing a high power output, but difficult in controlling the speed, particularly in controlling a high speed drive. The motor drive system is known to have merits and demerits that are reverse to those of the hydraulic drive system. For this reason, according to the hydraulic drive system, a substantial amount of time is required to drive the ram from a standby position to a press start position, thus posing a problem in operating efficiency. In addition, the hydraulic drive system occasionally accompanies a leakage of oil and, therefore, it is difficult to halt the lowering of the ram completely. On the other hand, the motor drive system poses such a problem that difficulty is often encountered with in applying a high load and does therefore have limitations in use thereof, one of which includes an incapability of handling with heavy plates. Also, in view of the structure of the motion translating mechanism, the motor drive system is generally considered difficult to accomplish a speed changeover between a high speed and a low speed.

JP Patent No. 3558679 referred to above pertains to the composite drive system utilizing the servomotor and the hydraulic cylinder concurrently, in which the lack of the power output with the motor drive system is compensated for by the hydraulic cylinder. In this composite drive system, positioning of the ram is accomplished by the motor drive system and the hydraulic cylinder is merely used in an auxiliary manner. More specifically, the composite drive system is designed such that the load imposed on the ball screw mechanism of the motor drive system is first measured by a load cell so that the hydraulic cylinder can be actuated only in the event of the shortage of the power output. With this composite drive system, since pressurization is accomplished basically by the ball screw mechanism, the servomotor capable of providing a large power output needs to be selected. For this reason, the abrupt stoppage performance appears to become untolerable.

JP Laid-open Patent Publication No. 2004-188460 referred to above discloses the dual servomotor system utilizing a first servomotor for a high speed low load use and a second servomotor for a low speed high load use, which system is designed such that the servomotor for the high speed low load use is used to drive the ball screw mechanism during a period in which the ram is driven from the standby position to the press start position, but the servomotor for the low speed high load use is used to drive the ball screw mechanism during the press operation. Since this dual servomotor system is such that drive and pressurization are accomplished only by means of the ball screw mechanism, the ball screw mechanism needs to be large in size. It has, however, been found that if the ball screw mechanism is large in size, the inertias is large during a high speed drive, resulting in an increase of the stopping distance. Also, because of the pressurization accomplished by the ball screw mechanism, it is incapable of being applied to a large-size press brake.

SUMMARY OF THE INVENTION

In view of the foregoing, preferred embodiments of the present invention provide a press machine of a type, in which a die on a movable side can be stably driven by a lifting mechanism for a high speed low load use and a press work can be assuredly accomplished by a lifting mechanism for a low speed high load use.

A press machine according to a preferred embodiment of the present invention includes a main body frame; a die on a stationary side, or a movable die, which is held in position in a fixed state relative to the main body frame; a die on a movable side, or a movable die, which is movable up and down between a standby position distant from the stationary die and a bottom dead center position adjacent the stationary die; a lifting mechanism to drive the movable die; and a control device to control the lifting mechanism. The lifting mechanism includes a motor driven lifting unit, having a servomotor as a drive source therefor, and a hydraulically driven lifting unit having a hydraulic actuator as a drive source therefor. The control device controls the lifting mechanism so that the movable die can be driven by the motor driven lifting unit from the standby position to a drive system changeover position immediately preceding a press start position at which the movable die starts contacting a workpiece to be processed and, also, the movable die can be driven by the hydraulically driven lifting unit from the drive system changeover position to the bottom dead center position.

According to the above described construction, by the motor driven lifting unit outputting a high speed, low load driving force, the die on the movable side is driven from the standby position towards the drive system changeover position and, by the hydraulically driven lifting unit outputting a low speed, high load driving force, the die on the movable side is driven from the drive system changeover position towards the bottom dead center position. Accordingly, the high speed and stabilized movement of the die on the movable side and the assured press work can be accomplished. Since the motor driven lifting mechanism does not participate in the pressurized drive of the die on the movable side, a motor driven lifting mechanism having a small capacity can be selected. For this reason, the inertia is small and the abstract stoppage performance is good. Also, when the die on the movable side is held at the standby position, it is supported by the motor driven lifting unit and, therefore, the die will not be affected by a leakage of oil in the hydraulically driven lifting unit.

In a preferred embodiment of the present invention, where the die on the movable side is an upper die, the movable die support member to support the die on the movable side may be supported by the main body frame in a suspended fashion, in which case a counterbalance to support at least a portion of the weight of the movable die support member is preferably used.

The use of the counterbalance makes it possible to selectively lower and lift the die on the movable side with a small driving force, and, therefore, the motor driven lifting unit can be compactized, and also, the energy efficiency can be increased.

In a preferred embodiment of the present invention, the hydraulic actuator may be a double acting hydraulic cylinder which includes a first cylinder chamber to generate a first driving force necessary to drive the die on the movable side from the drive system changeover position to the bottom dead center position and a second cylinder chamber to generate a second driving force necessary to return the die on the movable side from the bottom dead center position back to the drive system changeover position. In such a case, the hydraulically driven lifting unit may include the hydraulic cylinder, an oil pump capable of supplying an oil to the first cylinder chamber of the hydraulic cylinder, the counterbalance including an accumulator to apply a pressure to the second cylinder chamber, and a prefill valve operable to prevent the oil from outflowing from the first cylinder chamber when the oil pump operates to supply the oil towards the first cylinder chamber, but to permit the outflow of the oil from the first cylinder chamber when the oil pump operates to discharge the oil from the first cylinder.

The hydraulically driven lifting unit of the structure described above is such that when the oil is supplied by the oil pump to the first cylinder chamber, the hydraulic cylinder is actuated in a predetermined direction, accompanied by the movement of the die on the movable side from the drive system changeover position towards the bottom dead center position. At this time, the prefill valve acts to avoid an undesirable outflow of the oil from the first cylinder chamber. When the oil is discharged by the oil pump from the first cylinder chamber, the hydraulic cylinder is actuated in a reverse direction by the pressurized oil accumulated within the accumulator, allowing the die on the movable side to return from the bottom dead center position back to the drive system changeover position. At this time, the prefill valve acts to permit the outflow of the oil from the first cylinder chamber. The use of the accumulator is effective to reduce the number of control valves used and also to simplify the hydraulic circuit. This construction makes it possible to adjust the number of revolutions of the oil pump so that the operating position of the die on the movable side can be fixed accurately to accomplish the proper press work.

In a preferred embodiment of the present invention, a movable die support member to support the die on the movable side may be provided for tilting motion relative to the main body frame, in which the movable die support member is connected with a movable portion of the motor driven lifting unit through a link and is held in contact with a movable portion of the hydraulically driven lifting unit through a guide surface which preferably has a spherical or cylindrical shape, for example.

With the above described construction, the movable die support member can be tilted leftwards or rightwards.

Various preferred embodiments of the present invention can be applied to, for example, a press brake. In such a case, the motor driven lifting unit may be of a structure capable of translating a rotational motion of a servomotor into a linear motion by a ball screw mechanism, in which case a combination of the motor driven lifting unit and the hydraulically driven lifting unit is provided in a pair one on each side of the die on the movable side, with each of those combinations disposed with the motor driven lifting unit positioned outwardly of the hydraulically driven lifting unit.

If the motor driven lifting unit makes use of the ball screw mechanism, the die on the movable side can be accurately driven at a high speed while the structure thereof is simplified. Also, if the combination of the motor driven lifting unit and the hydraulically driven lifting unit is provided in a pair one on each of left and right positions, the die on the movable side can be elevated while the die on the movable side is retained in a properly leftward or rightward tilted fashion. The hydraulically driven lifting unit that is used in the practice of a high pressure press work is more bulky than the motor driven lifting unit. For this reason, if the hydraulically driven lifting unit, rather than the motor driven lifting unit, is disposed on an inner side, the maintenance of the lifting mechanism can be easily performed from leftward or rightward outside.

A press machine according to another preferred embodiment of the present invention includes a main body frame; a die on a stationary side which is held in position in a fixed state relative to the main body frame; a die on a movable side, which is movable up and down between a standby position distant from the stationary die and a bottom dead center position adjacent the stationary die; a lifting mechanism to drive the movable die; and a control device to control the lifting mechanism. The lifting mechanism includes a hydraulic cylinder which is a drive source; a first hydraulic circuit for high speed use operable to actuate the hydraulic cylinder at a high speed; and a second hydraulic circuit for low speed use operable to actuate the hydraulic cylinder at a low speed. The control device referred to above is operable to actuate the hydraulic cylinder through the first hydraulic circuit to drive the die on the movable side from the standby position to a hydraulic circuit changeover position immediately before a press start position at which the die on the movable side starts contacting a workpiece to be processed, and also to actuate the hydraulic cylinder by the second hydraulic circuit to drive the die on the movable side from the hydraulic circuit changeover position to the bottom dead center position.

In the hydraulically driven lifting unit of the above described construction, when the hydraulic cylinder is actuated by the high speed hydraulic circuit, the die on the movable side is moved from the standby position towards the hydraulic circuit changeover position, but when the hydraulic cylinder is actuated by the low speed hydraulic circuit, the die on the movable side is moved from the hydraulic circuit changeover position towards the bottom dead center position. Accordingly, the high speed and stabilized movement of the die on the movable side and the assured press work can be accomplished.

Any combination of at least two constructions, disclosed in the appended claims and/or the specification and/or the accompanying drawings should be construed as included within the scope of the present invention. In particular, any combination of two or more of the appended claims should be equally construed as included within the scope of the present invention.

The above and other elements, features, steps, characteristics and advantages of the present invention will become more apparent from the following detailed description of the preferred embodiments with reference to the attached drawings.

In any event, the present invention will become more clearly understood from the following description of preferred embodiments thereof, when taken in conjunction with the accompanying drawings. However, the preferred embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like elements throughout the several views.

DETAILED DESCRIPTION OF THE PREFERRED EMBODIMENTS

Figure 1:
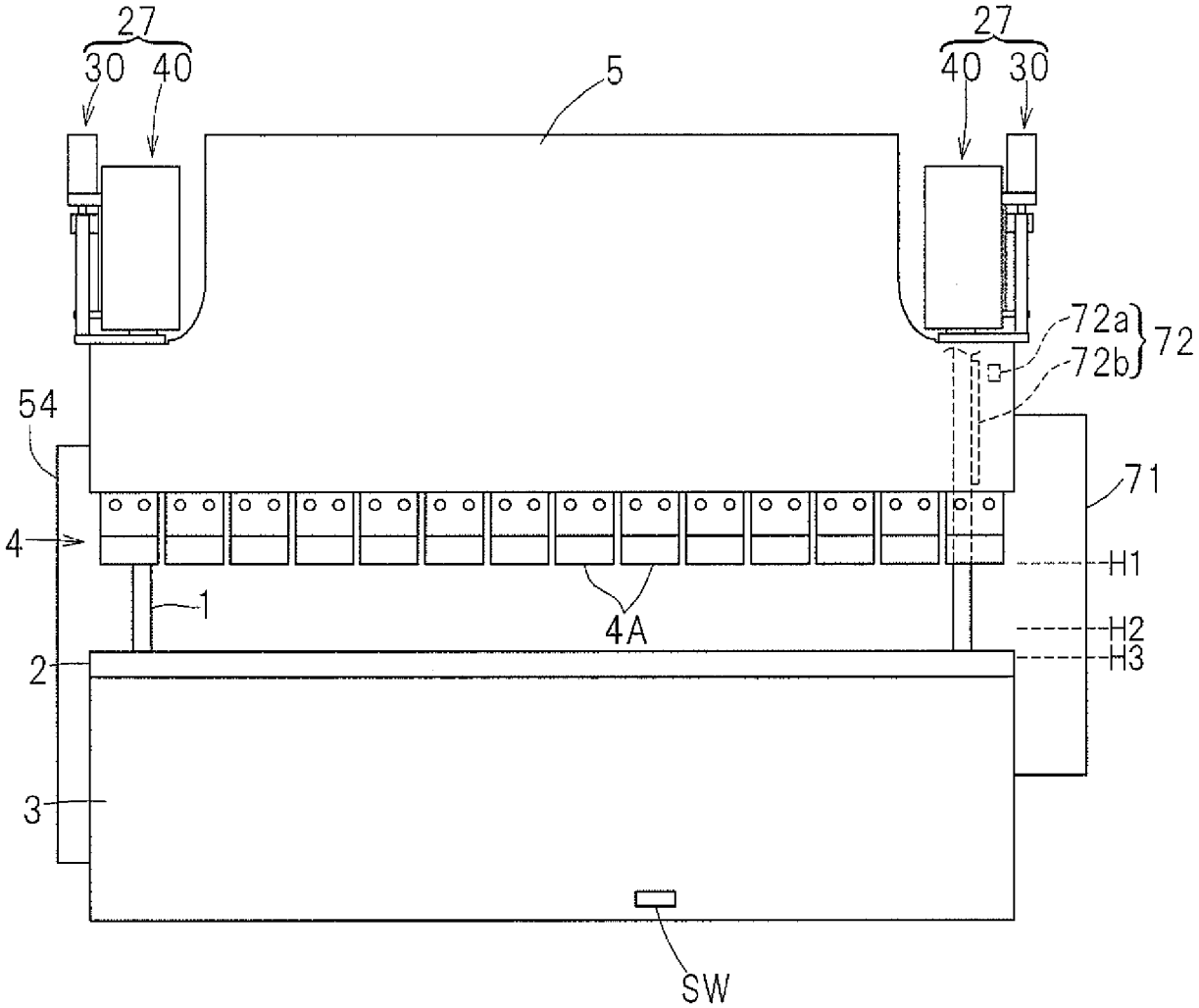
FIG. 1 is a front elevational view showing a press machine designed in accordance with a preferred embodiment of the present invention.
Figure 2:
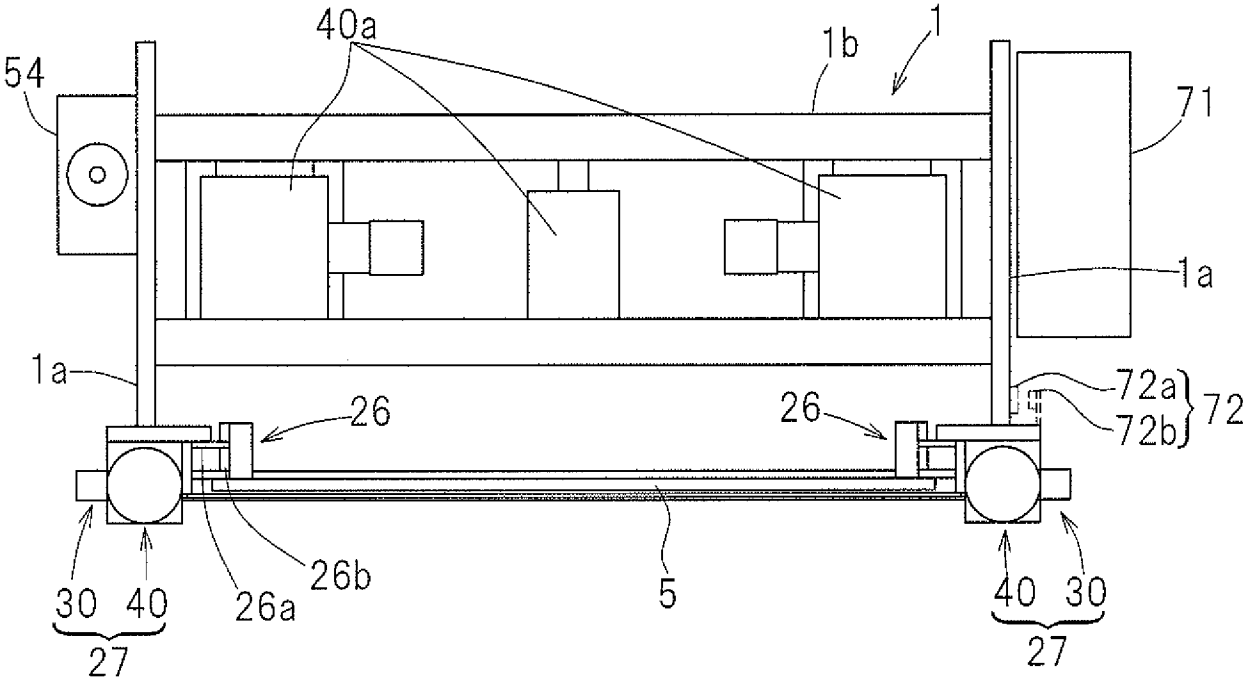
FIG. 2 is a top plan view showing the press machine.
Figure 3:
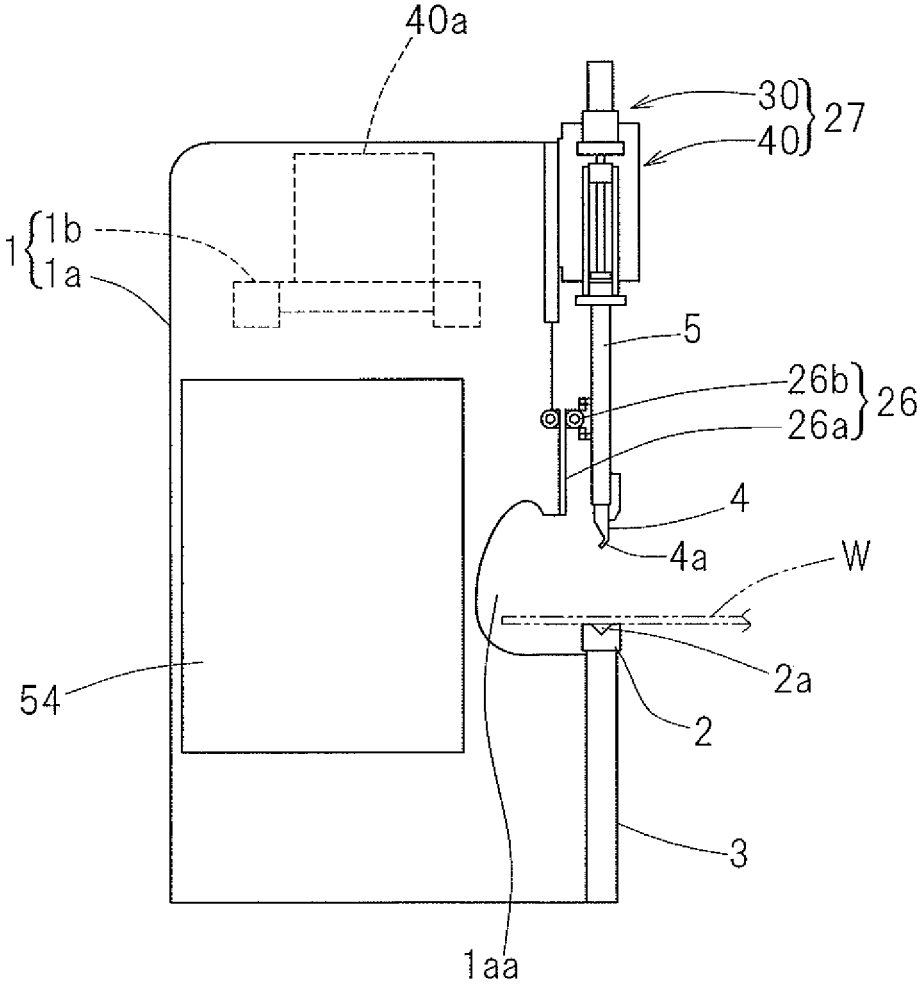
FIG. 3 is a side view showing the press machine.

Preferred embodiments of the present invention will now be described in detail with particular reference to the accompanying drawings. FIG. 1 illustrates a front elevational view of a press machine designed in accordance with a preferred embodiment of the present invention, FIG. 2 is a top plan view of such press machine, and FIG. 3 is a side view of such press machine. The illustrated press machine is a press brake, which includes a main body frame 1 having its front surface side provided with a table 3 to support a lower die 2, which may be a die on the stationary side, i.e., a stationary die, and a ram 5 defining and serving as a movable support member to support an upper die 4, which may be a die on the movable side, i.e., a movable die. The table 3 is fixed in position relative to the main body frame 1, but the ram 5 is movable up and down with its left and right side portions guided by respective guide units 26 as shown in FIGS. 2 and 3. The lower die 2 preferably is a unitary member, elongated in a transverse direction, which is provided with a forming recess 2*a* (FIG. 3). The upper die 4, including a tip end portion 4*a* (best shown in FIG. 3) that can be advanced into the recess 2*a* in the lower die 2, is of a generally rectangular shape having a substantial length in a transverse direction as is the case with the lower die 2, i.e., in a direction transverse to the longitudinal axis of the press machine, but includes a plurality of separate upper die segments 4A as best shown in FIG. 1. When the upper die 4 is lowered relative to a workpiece W to be processed such as, for example, a plate placed on the lower die 2 with the tip end portion 4*a* of the upper die 4 then advanced towards the recess 2*a* in the lower die 2, a bending process takes place to bend the workpiece W into a V-shaped or substantially V-shaped configuration.

The main body frame 1 includes left and right plate-shaped side frame segments 1*a* and a connecting frame segment 1*b* of a generally ladder-shaped configuration, as shown in FIG. 2, which connects respective upper regions of the left and right side frame segments 1*a* together. As shown in FIG. 3, the left and right side frame segments 1*a* are each provided with a respective reentrant 1*aa*, that is depressed inwardly from a generally intermediate portion of a front edge of the associated side frame segment 1*a*, so as to avoid an undesirable interference with a widthwise large workpiece W during the bending operation, that is, so as to accommodate a portion of the workpiece W which will lie at a location adjacent the side frame segments 1*a* when such workpiece W is placed above the lower die 2 ready for bending as shown by the phantom line in FIG. 3.

Figure 4B:
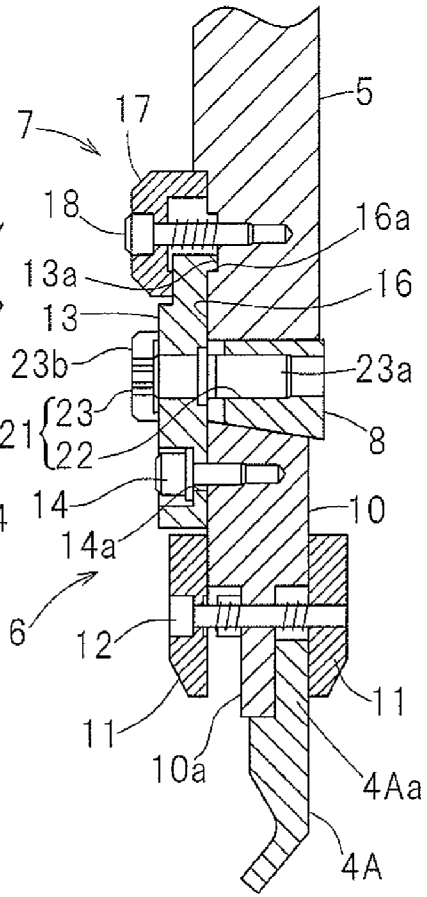
FIG. 4B is a side sectional view, with a portion cut out, showing the upper die support shown in FIG. 4A.
Figure 4A:
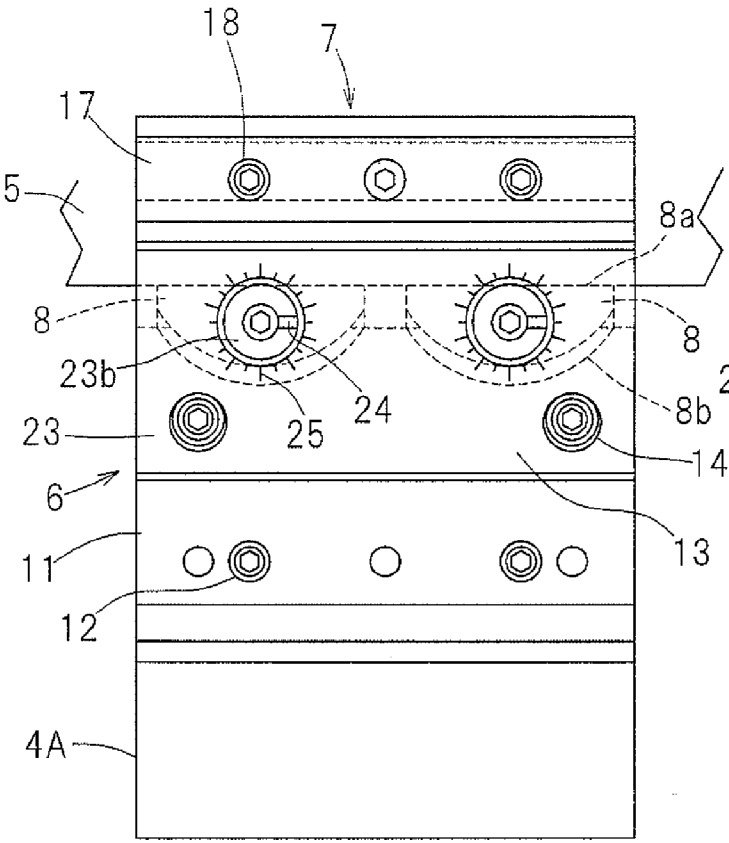
FIG. 4A is a front elevational view showing an upper die support included in the press machine.

Each of the separate upper die segments 4A of the upper die 4 is of a generally or substantially rectangular shape having a length, as measured in a direction parallel to the direction of movement of the ram 5, and a width as measured in a direction perpendicular to the direction of movement of the ram 5. A vertical position of each of the separate upper die segments 4A referred to above can be adjusted by an intermediate sag adjusting unit 6, best shown in FIGS. 4A and 4B. The intermediate sag adjusting unit 6 includes a die fixing subunit 7 that fixes the respective upper die segment 4A relative to the ram 5 to adjust the heightwise distance between the upper die segment 4A and the ram 5, and intermediate wedge members 8 interposed between the ram 5 and the respective upper die segment 4A to adjust the spacing between the ram 5 and the upper die segment 4A. In the illustrated instance, each of the separate upper die segments 4A is retained by an upper die holder 10 of a width equal to or substantially equal to the upper die segment 4A, and each of the intermediate wedge members 8 referred to above is used to adjust the spacing between the ram 5 and the upper die holder 10. Mounting of each of the separate upper die segments 4A onto the associated upper die holder 10 is accomplished by overlapping a thin walled upper portion 4Aa of the upper die segment 4A onto a thin walled lower portion 10*a* of the upper holder 10 in a face-to-face arrangement, then fastening front and rear retaining places 11, which are positioned on respective sides of the assembly of the thin walled upper portion 4Aa and the thin walled lower portion 10*a*, together preferably by use of a bolt 12. Thus, the thin walled upper portion 4Aa of the respective upper die segment 4A can be firmly sandwiched between the rear retaining plate 11 and the thin walled lower portion 10*a* of the upper die holder 10.

The die fixing subunit 7 has a width substantially equal to that of the upper die holder 10 and also includes a fixing member 13, which has an upper edge secured to a lower end of the ram 5 and a lower edge fixed to the upper die holder 10 preferably by bolts 14. The fixing member 13 has bolt holes 14*a* defined therein for the passage of the respective bolts 14 therethrough, each of which bolt holes 14*a* is in the form of a loose hole such as, for example, a slot that extends in a vertical direction parallel to the direction of movement of the ram 5 so as to leave an adjustment clearance in that vertical direction. Fitting of the fixing support member 13 to the ram 5 in the manner described above is accomplished by applying one surface (rear surface) of the upper edge of the fixing support member 13 to a vertical surface 16 of the ram 5 while a pressing member 17 of a generally L-shaped configuration is applied to the opposite surface (front surface) of the upper edge of the fixing support member 13, and then successively threading bolts 18 into the ram 5 through the pressing member 17 to urge the latter against the vertical surface 16 of the ram 5. The vertical surface 16 of the ram 5 includes an upwardly oriented stepped surface 16*a* defined therein so as to extend in the transverse direction and, on the other side, the fixing member 13 includes a catch member 13*a* defined therein so as to be engageable with the stepped surface 16*a* referred to above.

Figure 5:
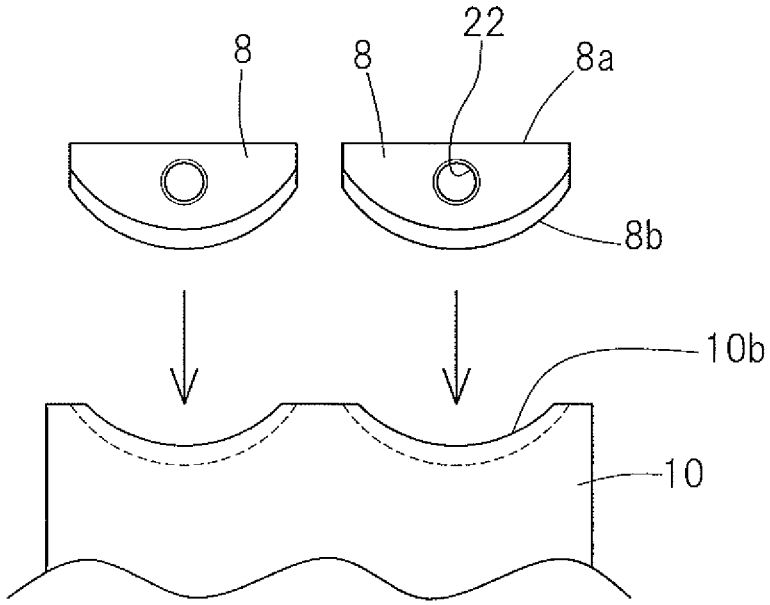
FIG. 5 is a front elevational view showing an intermediate wedge and an upper die holder in the upper die support, which are separated from each other.

The intermediate wedge members 8 are nested in two recesses 10*b* which are defined in an upper surface of the upper die holder 10 in side by side relation to each other. Each of those recesses 10*b* is of a shape occupying by a portion of the cylindrical surface having its longitudinal axis inclined forwardly upwardly. As best shown in FIG. 5, each of the intermediate wedge members 8 has an upper surface represented by a horizontal surface 8*a* perpendicular or substantially perpendicular to the direction of movement of the ram 5 and a lower surface represented by a cylindrical surface 8*b* that is downwardly concaved and inclined across the thickness of the upper die holder 10 so as to follow the curvature of the respective recess 10*b*. The upper surface represented by the horizontal surface 8*a* is slidingly held in contact with a lower edge surface of the ram 5 whereas the lower surface represented by the cylindrical surface 8*b* is held in sliding contact with an inner peripheral surface of the corresponding recess 10*b* to perform sliding movement in a direction across the thickness of the upper die holder 10 or in a forward-rearward direction and also in a circumferential direction of such corresponding recess 10*b*.

The die fixing subunit 7 referred to previously includes an anteroposterior position changing unit 21 that changes an anteroposterior position of each of the intermediate wedge member 8. This anteroposterior position changing unit 21 includes an internally threaded hole 22, defined in each of the intermediate wedge members 8 so as to extend in the forward-rearward direction thereof, and a corresponding screw member 23 adapted to extend through the fixing member 13 and including a tip end adapted to be threaded into the internally threaded hole 22. The anteroposterior position of each of the intermediate wedge members 8 is changed if the extent to which the screw member 23 is threaded into the internally threaded hole 22 is changed. The screw member 23 for each of the intermediate wedge members 8 includes a head 23*b* having a marking 24 provided therein to provide a visual indication of a rotational position of the screw member 23. Also, the fixing member 13 includes a front surface provided with a scale 25 cooperable with the marking 24 in the respective screw member 23 to indicate the phase in the rotational direction. It is to be noted that the scale 25 may have a numerical value descriptive of the heightwise position of the corresponding upper die segment 4A in dependence on the rotational position of the associated screw member 23.

A method of adjusting the height of each of the upper die segments 4A of the upper die 4 will be described in detail later.

As best shown in FIG. 2 showing the press machine as viewed from above, the ram 5 has its left and right side portions supported by the respective guide units 26 so that the ram 5 can be moved vertically relative to the main body frame 1 independently by left and right lifting mechanisms 27 that are drivingly engaged with the left and right side portions of the ram 5. Each of the guide units 26 includes a lift guide 26*a*, secured to the adjacent side frame segment 1*a* of the main body frame 1 so as to extend vertically, and a pair of rollers 26*b* provided on a rear surface side of the ram 5 and held in rolling contact with front and rear surfaces of the lift guide 26*a*. Each lifting mechanism 27 includes a combination of a motor driven lifting unit 30, preferably in the form of a servomotor as a first drive source therefor, and a hydraulically driven lifting unit 40 preferably in the form of a hydraulic actuator as a second drive source therefor. The motor driven lifting unit 30 is positioned on one side of the hydraulically driven lifting unit 40 laterally remote from the ram 5 which is then intervening between the left and right combinations of the lifting units 30 and 40 as clearly shown in FIG. 1.

Figure 6B:
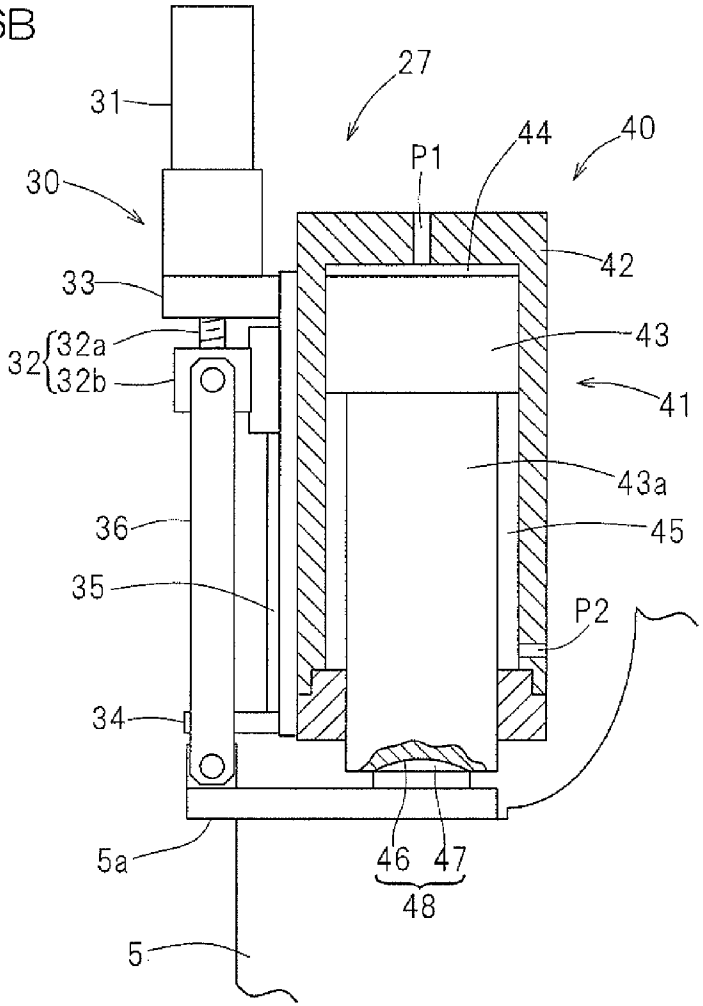
FIG. 6B is a side view of the left lifting mechanism shown in FIG. 6A.
Figure 6A:
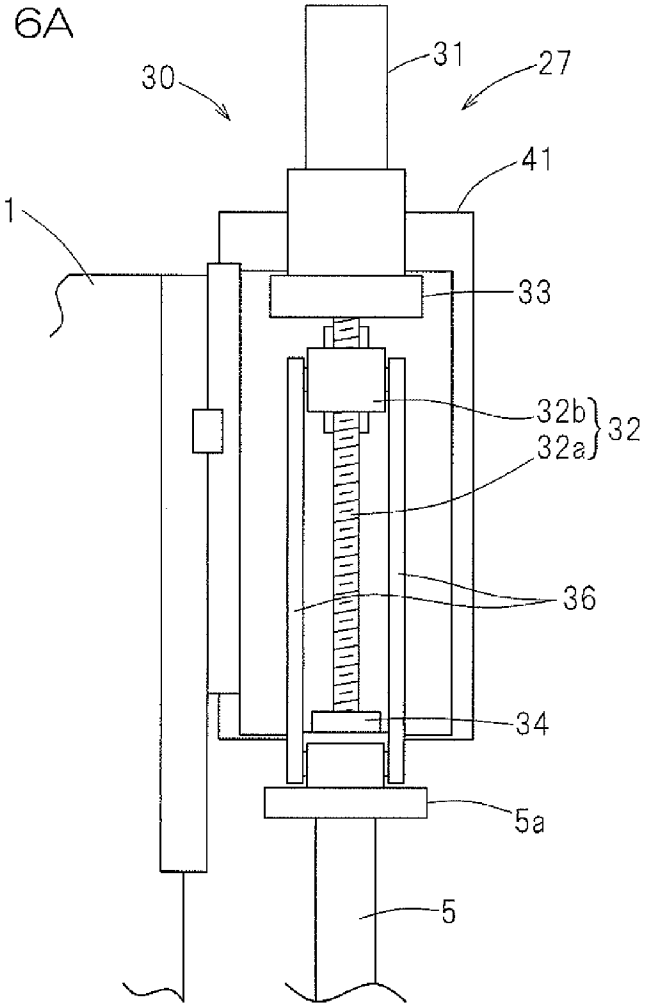
FIG. 6A is a front elevational view, with a portion cut out, showing a left lifting mechanism included in the press machine.

As shown in FIGS. 6A and 6B, the motor driven lifting unit 30 is operable to translate a rotary motion of a servomotor 31, defining a portion of the motor driven lifting unit 30, into a linear motion via a ball screw mechanism 32 also defining another portion of the motor driven lifting unit 30. The ball screw mechanism 32 referred to above includes a vertically extending screw shaft 32*a* and a nut 32*b* threadingly mounted on the screw shaft 32*a* through a chain of balls (not shown) built therein. The screw shaft 32*a* includes opposite, upper and lower ends rotatably supported respectively by an upper screw shaft support member 33 and a lower screw shaft support member 34 both secured to a cylinder tube 42 of a hydraulic cylinder 32 as will be described later. The cylinder tube 42 referred to above is fixed to the main body frame 1. The nut 32*b*, which is a movable portion of the motor driven lifting mechanism 30, is slidable along a vertically extending translatory guide 35 that is secured to the cylinder tube 42. This nut 32*b* is connected through front and rear links 36 with a connecting plate 5*a* that is provided in each of left and right shoulders of the ram 5.

The screw shaft 32*a* has an upper end drivingly coupled with an output shaft (not shown) of the servomotor 31 so that when the servomotor 31 is driven, the screw shaft 32*a* can be driven selectively in one of first and second directions opposite to each other about its own longitudinal axis. When the screw shaft 32 is so driven, the nut 32*b* is elevated up or down along the screw shaft 32*a* with the movement of the nut 32*b* being transmitted to the ram 5 through the links 36. The servomotor 31 is fixedly mounted on the upper screw shaft support member 33.

The hydraulically driven lifting unit 40 includes a double acting hydraulic cylinder 41 operable as a hydraulic actuator. The hydraulic cylinder 41 includes a reciprocatingly movable piston 43 accommodated within the cylinder tube 42, secured to the main body frame 1, to perform sliding movement up and down, and the piston 43 so accommodated within the cylinder tube 42 divides the interior of the cylinder tube 42 into a first cylinder chamber 44 of the bottom side of the cylinder tube 42 and a second cylinder chamber 45 of the top side of the cylinder tube 42. The cylinder tube 42 includes oil flow ports P1 and P2 defined therein in communication with the first and second cylinder chambers 44 and 45, respectively.

The piston 43 includes a bottom end from which a piston rod 43*a* extends downwardly. A lower end of the piston rod 43*a* remote from the piston 43 includes an end surface including a spherical recess 46 depressed axially inwardly of the piston rod 43*a* so as to define a spherical seat, and a spherical projection 47 provided on the respective connecting plate 5*a*, provided in each of left and right shoulders of the ram 5 as hereinbefore described, is received within and held in contact with the spherical seat 46. The spherical recess or seat 46 and the spherical projection 47, both referred to above, cooperate with each other to define a pivot joint 48.

Figure 7:
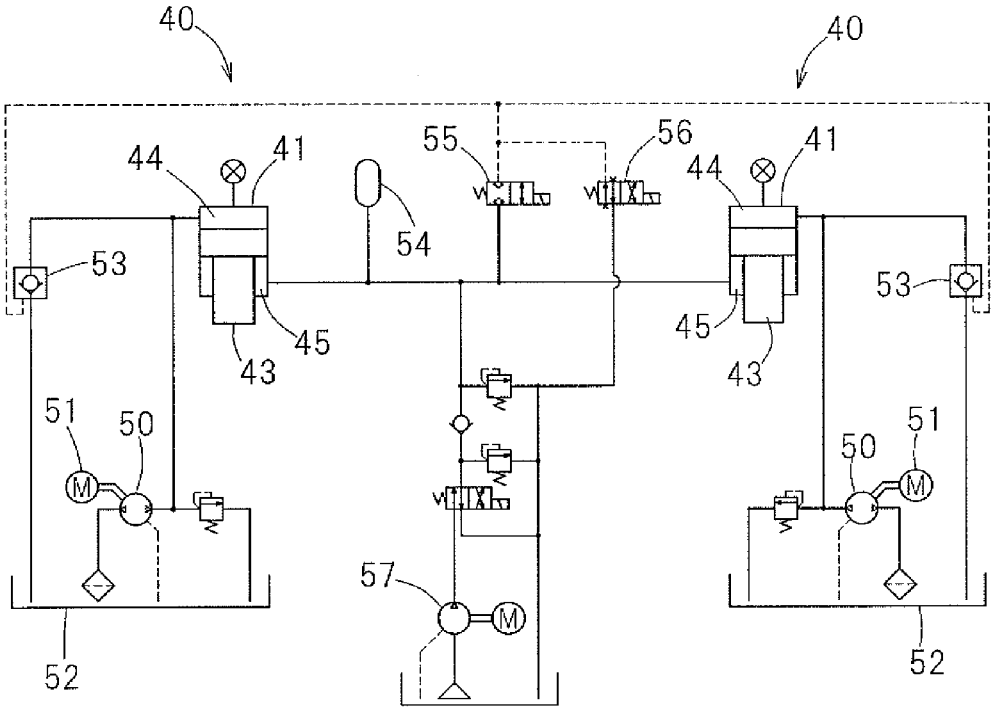
FIG. 7 illustrates a hydraulic circuit for a hydraulically driven lifting unit defining a portion of the press machine.

A hydraulic circuit used in association with the hydraulically driven lifting unit 40 is shown in FIG. 7. The left and right hydraulically driven lifting units 40 make use of respective main oil pumps 50 each fluid connected with the first cylinder chamber 44 of the associated hydraulic cylinder 41 through a suitable piping. The main oil pump 50 in each of the left and right hydraulically driven lifting units 40 is of a type in which when the number of revolutions and the direction of revolution of a corresponding pump drive motor 51 are changed, the amount of discharge of the oil and the direction of discharge of the oil can be controlled. A piping connecting between the first cylinder chamber 44 and the oil tank 52 is provided with a pressure controlled prefill valve 53 to discharge the oil within the respective oil tank 52 to the first cylinder chamber 44 when the necessity arises. Also, the respective second cylinder chambers 45 of the left and right hydraulic cylinders 41 are fluid connected with an accumulator 54 that is common to both of the left and right hydraulically driven lifting units 40. This accumulator 54 functions as a counterbalance capable of supporting a portion of the weight of the ram 5 when a pressure is applied to the second cylinder chambers 45 of the hydraulic cylinder s 41 at all times.

The pressure control of the prefill valve 53 referred to above is carried out by a pilot pressure utilizing the pressure, accommodated within the accumulator 54, through an open-close valve 55 capable of selectively assuming one of open and closed positions and a direction control valve 56 when those valves 55 and 56 are electromagnetically controlled. Other than those, an auxiliary pump 57 is provided to supply the oil to the accumulator 54. A main body portion 40*a* (best shown in FIG. 2) of the hydraulically driven lifting unit 40 excluding the hydraulic cylinders 41 and the accumulator 54 is mounted on the connecting frame segment 1*b* of the main body frame 1, but the accumulator 54 is disposed laterally leftwards of the main body frame 1.

The press machine is provided with a press switch SW (best shown in FIG. 1) of a pedaling type capable of outputting a command signal necessary to execute the press work and a linear scale 72 (best shown in FIGS. 1 and 2) to detect the heightwise position of the upper die 4. The linear scale 72 includes a vertically extending scale portion 72*a*, fitted to one of the side frame segment, for example, the right side frame segment 1*a*, and a read-out head 72*b* fitted to the ram 5 to read calibrations on the scale portion 72*a*.

Figure 8:
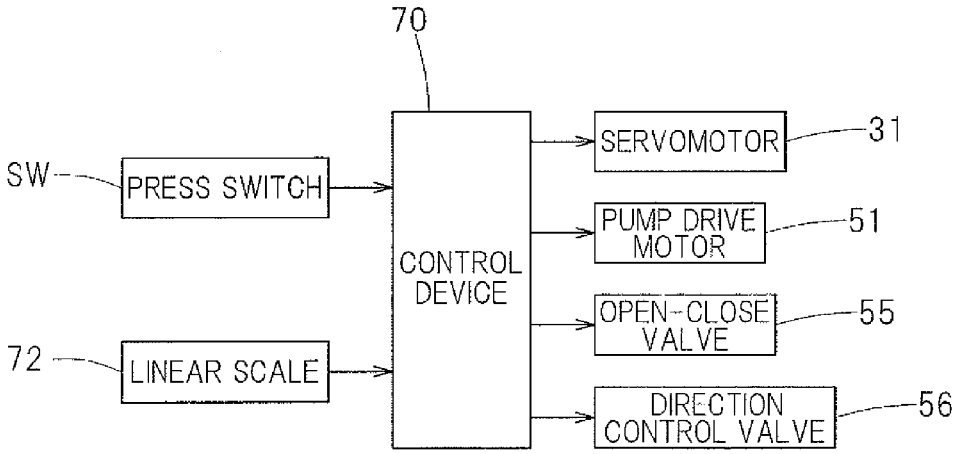
FIG. 8 illustrates a block diagram of a control device defining a portion of the press machine.

FIG. 8 illustrates a circuit block diagram of a control device operable to control the lifting mechanisms 27. This control device, now identified by 70, may be provided either inside a control board 71 (best shown in FIG. 1) or outside of the control board 71. The control device 70 is preferably in the form of a computer controlled numerical control device of a type which outputs respective command signals to the servomotor 31, the pump drive motor 51, the open-close valve 55 and the direction control valve 56 on the basis of inputs from the press switch SW and the linear scale 72. The control device 70 performs the following series of controls.

Under normal conditions, the upper die 4 is in a condition being held at the standby position H1 (best shown in FIG. 1). When starting from this condition a command signal from the press switch SW is inputted, the servomotor 31 is driven in a direction required to lower the ram 5, causing the motor driven lifting unit 30 to lower the ram 5 with a high speed, low load driving force. At this time, when the open-close switch 55 is brought to the open position, the pressure accumulated within the accumulator 54 is applied to the prefill valve 53 to bring the latter to an open position. By so doing, the oil within the oil tank 52 is supplied to the first cylinder chamber 44 of the hydraulic cylinder 41 and, at the same time, the piston 43 of the hydraulic cylinder 41 descends downwardly, as viewed in FIG. 6B, following the operation of the ball screw mechanism 32 of the motor driven lifting unit 30.

When the ram 5 is lowered down to a heightwise position at which the upper die 4 arrives at the drive system switching position H2 (best shown in FIG. 1), the servomotor 31 is halted and, at the same time, the pump drive motor 51 is driven to allow the main oil pump 50 to supply the oil to the first cylinder chamber 44 of the hydraulic cylinder 41. By so doing, switching over to the hydraulically driven lifting unit 40 is performed, and then the ram 5 is further lowered with a low speed, high load driving force. At this time, the open-close valve 55 is brought to the closed position and, at the same time, the direction control valve 56 is switched over to a position at which the oil can be returned from the prefill valve 53, following closure of the prefill valve 53.

When the ram 5 then lowering arrives at a heightwise position where the upper die 4 attains the bottom dead center position H3 (as shown in FIG. 1), the pump drive motor 51 is reversed. As a result, the oil is discharged from the first cylinder chamber 44 of the hydraulic cylinder 41 and the pressure oil accumulated within the accumulator 54 is hence supplied to the second cylinder chamber 45, accompanied by an ascending motion of the ram 5. The driving force available at that time makes use of the pressure of the accumulator 54 and is, therefore, under a low load condition as compared with the driving force generated by the main oil pump 50.

When the ram 5 then ascending is lifted to a heightwise position where the upper die 4 attains the driving system changeover position H2, the pump drive motor 51 is halted, and at the same time, the servomotor 31 is rotated in a direction required to lift the ram 5. By so doing, switching over to the drive by the motor driven lifting unit 30 is performed and the ram 5 is ascended by the high speed, low load driving force.

With the lifting mechanisms 27 controlled as hereinabove described, by the action of the motor driven lifting unit 30 capable of outputting the high speed, low load driving force the upper die 4 can be moved up or down between the standby position H1 and the driving system changeover position H2 and, on the other hand, by the action of the hydraulically driven lifting mechanism 40 capable of outputting the low speed, high load driving force the upper die 4 can be moved up or down between the driving system changeover position H2 and the bottom dead center position H3. The ball screw mechanism 32 included in each of the motor driven lifting units 30 is capable of accurately driving the upper die 4 at a high speed even though the structure thereof is simplified. The hydraulically driven lifting units 40 are capable of accurately fixing an operating position of the upper die 4 when the respective pump drive motors 51 are controlled to adjust the number of revolutions of the oil pumps 50. In view of this, a high speed and stable movement of the upper die 4 and an assured press work can be both accomplished.

Each of the motor driven lifting units 30 does not participate with a pressurized drive for the press work and can therefore be a small capacity type. For this reason, inertia is low and an abrupt stoppage performance is good. Also, since the upper die 4 is supported by the motor driven lifting unit 30 when the upper die 4 is held at the standby position H1, the upper die 4 will not be affected by a leakage of oil from the hydraulically driven lifting mechanism 40.

Since the hydraulically driven lifting units 40 are provided with the common accumulator 54 as a counterbalance, the upper die 4 can be driven, i.e., selectively lowered or lifted with a small driving force. For this reason, not only can each of the motor driven lifting units 30 be undersized, but the energy efficiency is high. Also, the use of the accumulator 54 makes it possible to reduce the number of control valves used and, therefore, the hydraulic circuit for each of the hydraulically driven lifting units 40 can be simplified.

Since the ram 5 is tiltably arranged relative to the main body frame 1 and the combination of the motor driven lifting unit 30 and the hydraulically driven lifting mechanism 40 in the lifting mechanism 27 is provided in a pair one on the left side and the other on the right side, the ram 5 can be held at any arbitrarily chosen angle relative to the transverse direction. Since the bulky hydraulically driven lifting units 40 are positioned inwardly of the associated motor driven lifting mechanisms 30, maintenance and servicing of the lifting mechanism 27 can be performed from either left or right side of the machine.

The connecting plate 5*a* of the ram 5 and the nut 32*b* defining the movable portion of each of the motor driven lifting units 30 are connected with each other through the links 36, and the connecting plate 5*a* and the piston rod 43*a* defining the movable portion of each of the hydraulically driven lifting units 40 are connected through the pivot joint 48 including a spherical contact interface. Accordingly, tilting of the ram 5 leftwards or rightwards can be accommodated. It is to be noted that the connecting plate 5*a* and the piston rod 43*a* may be held in contact with each other through a contact interface of a cylindrical surface shape.

The height of each of the separate die segments 4A of the upper die 4 preferably is individually adjusted by the intermediate sag adjusting unit 6 based on, for example, the wall thickness of the workpiece W to be processed, the material of the workpiece W and the shape to which the workpiece W is desired to be bent. This is for the purpose of avoiding a possible deflection of a transverse intermediate portion of the ram 5 in a direction, opposite to the direction in which the pressure is applied, to such an extent that the relation in height between the upper die 4 and the lower die 2 will become improper.

The heightwise adjustment of each of the separate die segments 4A can be accomplished by changing the anteroposterior position of the corresponding intermediate wedge members 8 via the anteroposterior position changing unit 21. More specifically, while the bolts 14 are loosened, the extent to which the screw members 23 of the anteroposterior position changing unit 21 are threaded into the respective internally threaded holes 23 is changed. By so doing, the anteroposterior position of the intermediate wedge members 8 can be altered. Where the intermediate wedge members 8 are changed to an anterior or forward position, the upper die holder 10 is urged downwardly by the cylindrical surface 8*b* of the respective intermediate wedge member 8. On the other hand, where the intermediate wedge members 8 are changed to a posterior or rearward position, a gap is developed between the cylindrical surface 8*b* of the intermediate wedge members 8 and the recess 10*b* of the upper die holder 10 and, therefore, the upper die holder 10 is lifted a distance corresponding to such gap. This in turn results in a change in relative positional relation between the fixing member 13 and the upper die holder 10 in the vertical direction. Since each of the bolt holes 14*a* in the fixing member 13 preferably is in the form of the slot extending in the vertical direction, it is possible to accommodate the change in relative positional relation referred to above. When one of the calibrations of the scale 25 aligned with the marking 24 on the screw member 23 is read out, the heightwise position of the respective die segment 4A is readily ascertained. After the completion of the adjustment, the bolts 14 are fastened to secure the fixing member 13 and the upper die holder 10.

Figure 9:
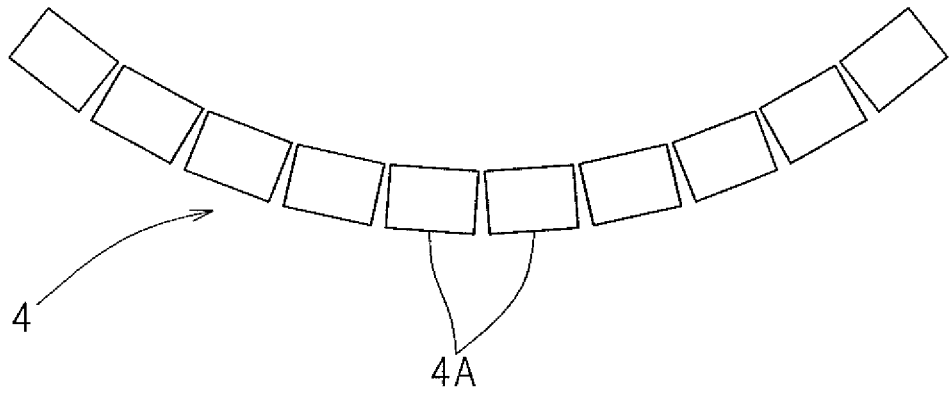
FIG. 9 is a front elevational view showing an arrangement of die segments of the upper die.

If the respective anteroposterior positions of the two intermediate wedge members 8 included in each of the upper die holders 10 are differentiated from each other, it is possible to tilt the corresponding die segment 4A leftwards or rightwards. By so doing, for example, as shown in FIG. 9, the lower edges of the separate die segments 4A can be positioned so that the imaginary line connecting the respective lower edges of the separate die segments 4A may represent a curved shape, that is, a crowning shape. This shape makes it possible that various portions of the separate die segments 4A apply an equal force to the workpiece W to be processed, thus accomplishing a favorable bending work.

Since the surface of each of the intermediate wedge members 8, which contacts the upper die holder 10, is shaped so as to represent the cylindrical surface 8*b* protruding towards the upper die holder 10, the upper die holder 10 can be tilted to any desired angle relative to the intermediate wedge member 8. Also, even though the upper die holder 10 is held at any desired angle, the intermediate wedge member 8 and the upper die holder 10 can be maintained in a surface contact condition, and therefore, a sufficient bearing force against the pressurization can be secured at all times.

Since an upper surface of each of the intermediate wedge members 8 represents the horizontal surface 8*a*, the height of the intermediate wedge member 8 can be reduced. Also, if the upper surface is represented by the horizontal surface 8*a* as described above, the intermediate wedge member 8 can be easily slid leftwards or rightwards relative to the ram 5 and, therefore, the leftward or rightward position of the respective separate die segment 4A can be easily adjusted. The adjustment of the leftward or rightward position of the separate die segment 4A is accomplished while the bolts 18 are loosened to release the pressing member 17 from applying a pressing force to the fixing member 13, but since an undesirable drop of the fixing member 13 is regulated with the catch member 13*a* of the fixing member 13 engaged with the stepped surface 16*a* of the ram 5, the adjusting job can be easily performed.

An alternative to the hydraulic circuit of the hydraulically driven lifting units 40 shown in and described with particular reference to FIG. 7 will be described below. Accordingly, different hydraulic circuits for the hydraulically driven lifting units 40 will now be described.

Figure 10:
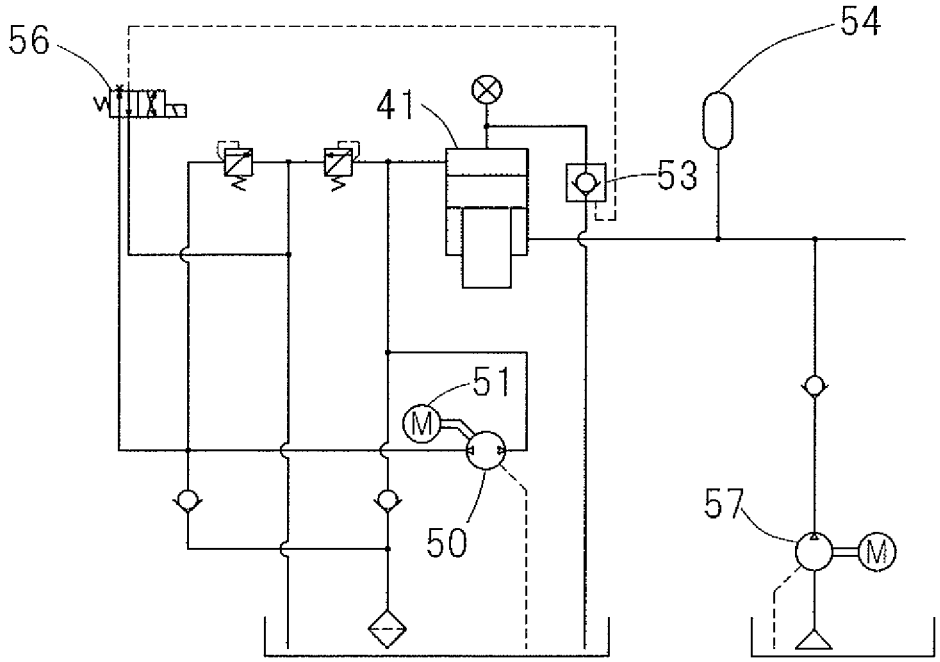
FIG. 10 illustrates a hydraulic circuit for a different hydraulically driven lifting unit.

The hydraulically circuit for the hydraulically driven lifting units 40 shown in FIG. 10 differs from that shown in FIG. 7 in that in the circuit of FIG. 10 the selective opening and closure of the prefill valve 53 is performed by the main oil pump 50. Specifically, in a condition in which the main oil pump 50 is reversed, the direction control valve 56 is changed to allow a pilot pressure to be applied to the prefill valve 53 to open the prefill valve 53. Other structural features preferably are basically similar to those of the hydraulic circuit shown in and described with particular reference to FIG. 7 and, therefore, only a portion of the hydraulic circuit associated with the left hydraulically driven lifting unit 40 is shown in FIG. 10.

Figure 11:
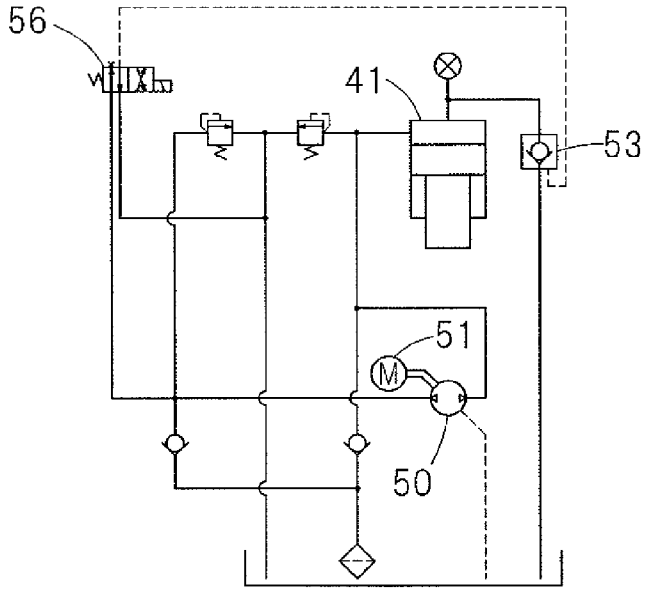
FIG. 11 illustrates a hydraulic circuit for another different hydraulically driven lifting unit.

The hydraulic circuit for the hydraulically driven lifting units 40 shown in FIG. 11 is an example in which the counterbalance of the ram 5 is provided not inside the hydraulic circuit, but outside the hydraulic circuit. For this reason, the hydraulic circuit of the hydraulically driven lifting units 40 does not make use of any accumulator such as shown by the reference numeral 54 in FIG. 7. The counterbalance (not shown) that can be used other than the accumulator may include, for example, a gas damper, a gas spring, a coil spring, a weight or the like. Since the left and right hydraulically driven lifting units 40 are substantially identical in structure with each other, only the left hydraulically driven lifting unit 40 is shown in FIG. 11.

Figure 12:
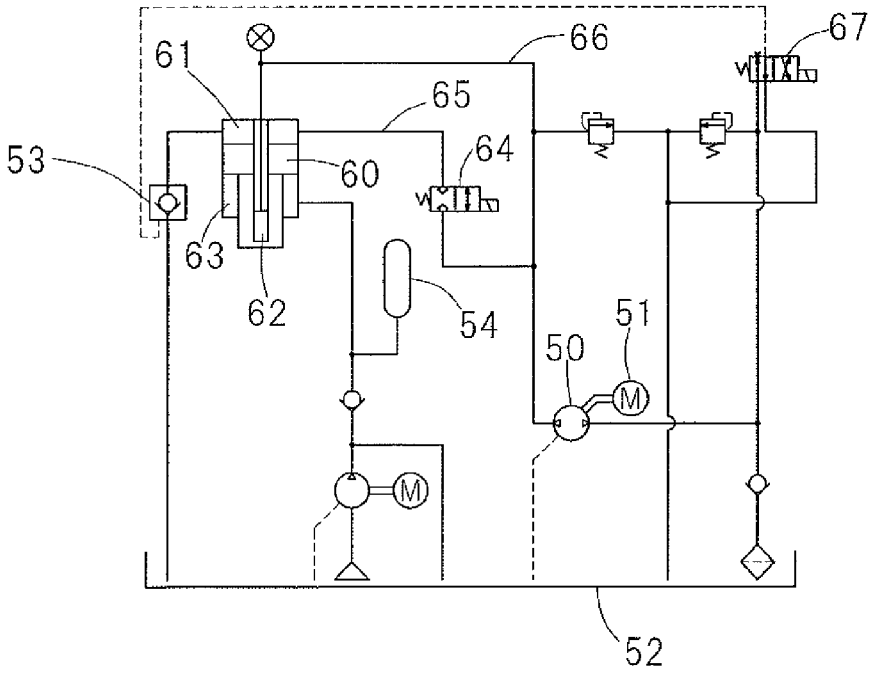
FIG. 12 illustrates a hydraulic circuit for a yet another different hydraulically driven lifting unit.

The hydraulic circuit for the hydraulically driven lifting units 40 shown in FIG. 12 is designed so as to perform both of lifting or lowering of the ram 5 with the high speed, low load driving force and also lifting or lowering of the ram 5 with the low speed, high load driving force. As the hydraulic actuator, a multiple hydraulic cylinder 60 including first, second and third cylinder chambers 61, 62 and 63 is preferably used. The second cylinder chamber 62 is provided inside the piston and an oil passage leading to the second cylinder chamber 62 is provided inside the rod that is fixed to the cylinder tube and is slidably engaged with the piston. The first cylinder chamber 61 is used to generate the low speed, high load driving force and is fluid connected with the main oil pump 50 through a low speed hydraulic circuit 65 with the intervention of an open-close valve 64 capable of selectively assuming one of open and closed positions. The second cylinder chamber 62 is used to generate the high speed, low load driving force and is fluid connected directly with the main oil pump 50 through a high speed hydraulic circuit 66. The third cylinder chamber 63 is used to generate a driving force for return use and is fluid connected with the accumulator 54.

The main oil pump 50 referred to above is of a type capable of controlling the amount of discharge of the oil and the direction of discharge of the oil when the number of revolutions and the direction of revolution of the pump drive motor 51 are altered, as is the case with FIG. 7. On a piping connecting between the first cylinder chamber 61 and the oil tank 52, the pressure controlled prefill valve 53 is provided to flow the oil within the oil tank 52 to the first cylinder chamber 61 when the necessity arises. By switching the direction control valve 67 while the main oil pump 50 is reversed, a pilot pressure is applied to the prefill valve 53 to open the latter. Since the left and right hydraulically driven lifting units 40 are substantially identical in structure with each other, only the left hydraulically driven lifting unit 40 is shown in FIG. 12.

This hydraulically driven lifting unit 40 is designed so that when the multiple hydraulic cylinder 60 is actuated with the oil supplied by the high speed hydraulic circuit 66 to the first cylinder chamber 61, the upper die 4 can be moved from the standby position H1 (best shown in FIG. 1) to the hydraulic circuit changeover position immediately before the press start position at which the upper die 4 starts contacting the workpiece to be processed. Further, when the multiple hydraulic cylinder 60 is actuated with the oil supplied by the low speed hydraulic circuit 65 to the second cylinder chamber 62, the upper die 4 can be moved from the hydraulic circuit changeover position to the bottom dead center position with high load driving force. Also, when the multiple hydraulic cylinder 60 is actuated with the oil within the accumulator 54 supplied to the third cylinder chamber 63, the upper die 4 can be returned from the bottom dead center position back to the standby position. In this way, even when two channel driving forces are outputted by the hydraulically driven lifting unit 40, the high speed and stable movement of the upper die 4 and the assured press work can be accomplished.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

REFERENCE NUMERALS

1 . . . Main body frame
2 . . . Lower die
3 . . . Table
4 . . . Upper die
4A . . . Separate die segment
5 . . . Ram (Movable die support member)
30 . . . Motor driven lifting unit
31 . . . Servomotor
32 . . . Ball screw mechanism
32*b* . . . Nut (Movable portion)
36 . . . Link
40 . . . Hydraulically driven lifting unit
41 . . . Hydraulic cylinder (Hydraulic actuator)
44 . . . First cylinder chamber
45 . . . Second cylinder chamber
46 . . . Spherical recess
47 . . . Spherical projection
50 . . . Main oil pump
53 . . . Prefill valve
54 . . . Accumulator (Counterbalance)
60 . . . Multiple hydraulic cylinder
65 . . . Low speed hydraulic circuit
66 . . . High speed hydraulic circuit
H1 . . . Standby position
H2 . . . Drive system changeover position
H3 . . . Bottom dead center position

What is claimed is:

1. A press machine comprising:

a main body frame;

a die on a stationary side which is held in position in a fixed state relative to the main body frame;

a die on a movable side, which is movable up and down between a standby position distant from the stationary die and a bottom dead center position adjacent the stationary die;

a lifting mechanism to drive the movable die, the lifting mechanism including a motor driven lifting unit including a servomotor as a drive source therefor, and a hydraulically driven lifting unit including a hydraulic actuator as a drive source therefor; and a control device programmed to control the lifting mechanism; wherein the control device is programmed to control the lifting mechanism so that the movable die is driven by the motor driven lifting unit from the standby position to a drive system changeover position immediately preceding a press start position at which the movable die starts contacting a workpiece to be processed, and the movable die is driven by the hydraulically driven lifting unit from the drive system changeover position to the bottom dead center position.

2. The press machine as claimed in claim 1, further comprising a movable die support member to support the die on the movable side, which is an upper die, the movable die support member being supported by the main body frame in a suspended fashion, and a counterbalance to support at least a portion of a weight of the movable die support member.

3. The press machine as claimed in claim 2, wherein the hydraulic actuator is a double acting hydraulic cylinder including a first cylinder chamber to generate a first driving force necessary to drive the die on the movable side from the drive system changeover position to the bottom dead center position and a second cylinder chamber to generate a second driving force necessary to return the die on the movable side from the bottom dead center position back to the drive system changeover position; and the hydraulically driven lifting unit includes:

the hydraulic cylinder;

an oil pump arranged to supply an oil to the first cylinder chamber of the hydraulic cylinder;

the counterbalance including an accumulator to apply a pressure to the second cylinder chamber; and a prefill valve operable to prevent the oil from outflowing from the first cylinder chamber when the oil pump operates to supply the oil towards the first cylinder chamber, but to permit the outflow of the oil from the first cylinder chamber when the oil pump operates to discharge the oil from the first cylinder.

4. The press machine as claimed in claim 1, further comprising a movable die support member to support the die on the movable side, the movable die support member being arranged to perform a tilting motion relative to the main body frame; wherein the movable die support member is connected with a movable portion of the motor driven lifting unit through a link and is held in contact with a movable portion of the hydraulically driven lifting unit through a guide surface which has a spherical shape or a cylindrical shape.

5. The press machine as claimed in claim 1, wherein the press machine is a press brake;

the motor driven lifting unit is arranged to translate a rotational motion of a servomotor into a linear motion by a ball screw mechanism;

a combination of the motor driven lifting unit and the hydraulically driven lifting unit is provided in a pair one on each side of the die on the movable side; and each of the combinations is arranged with the motor driven lifting unit positioned outwardly of the hydraulically driven lifting unit.

* * * * *